United States Patent [19]

Evens

[11] Patent Number: 5,056,500

[45] Date of Patent: Oct. 15, 1991

[54] FURNACE DAMPER MEANS

[76] Inventor: Lance J. Evens, 2028 Grenoble, Carrollton, Tex. 75007

[21] Appl. No.: 616,666

[22] Filed: Nov. 21, 1990

Related U.S. Application Data

[63] Continuation of Ser. No. 398,423, Aug. 25, 1989, abandoned.

[51] Int. Cl.[5] ..... F24H 3/02

[52] U.S. Cl. ..... 126/110 R; 126/116 A; 126/112; 126/285 B; 236/1 G

[58] Field of Search ..... 236/1 G; 431/20; 126/285 B, 112, 110 R, 116 A

[56] References Cited

U.S. PATENT DOCUMENTS

| | | | |
|---|---|---|---|
| 2,780,146 | 6/1956 | Schoelles | 251/306 |
| 3,092,320 | 6/1963 | Powers | 236/1 G |
| 3,820,526 | 6/1974 | Van Vliet | 126/110 R |
| 4,155,699 | 5/1979 | Hansen | 431/20 |
| 4,274,392 | 6/1981 | Meyers | 126/285 B |

*Primary Examiner*—Carroll B. Dority

[57] ABSTRACT

A furnace comprises a housing, a fan or blower for moving air through housing, a burner in the housing, fuel supply means operatively connected to the burner, a heat exchanger in the housing a combustion chamber, the burner cooperating with said combustion chamber, an enclosure enclosing the heat exchanger and burner, said enclosure having an opening therein, and a damper operable to control the flow of air through said opening to the heat exchanger. The damper comprises a plate member pivotally mounted in the housing for opening and closing said opening. Preferably a drive motor opens the plate member and a spring biases the plate member closed. The damper is closed when the burner is off and is open when the burner is on. There is a circuit associated with the fuel supply means which is responsive to a predetermined open position of the plate member for permitting the flow of fuel through the fuel supply means when the plate member is open to said predetermined open position. A pilot hole is provided in the plate member for supplying limited air to said burner to maintain combustion for a pilot flame.

5 Claims, 3 Drawing Sheets

FURANCE DAMPER MEANS

This is a continuation of application Ser. No. 07/398,423, filed Aug. 25, 1989 and now abandoned.

BACKGROUND OF THE INVENTION

The present invention relates to an off cycle damper system for a furnace and more particularly to a furnace having damper means adjacent an inlet opening to a burner means and heat exchanger means associated therewith for closing the inlet opening when the burner means is off, and when said damper means is open to a predetermined position, said burner means may be ignited.

It is known in the art to provide an automatic damper in an exhaust conduit or flue conduit leading from a furnace combustion chamber and heat exchanger associated therewith to the atmosphere. When the damper is closed, the operation of the fuel feeding device will be stopped. The damper may be opened by a motor and closed by gravity. A control is provided to prevent the supply of fuel when the damper is closed. One patent exemplifying such prior art device is Lencke et al. 2,085,912.

Other patents are known which describe control systems for controlling a flue damper in a furnace flue. See, for example, Zivny 4,416,611, Clouser 4,570,847; and Grant 4,619,602. Also, it is known from Butzen 4,421,096, for example, to provide a flue damper having a motor for driving the damper closed and a spring for biasing the damper open.

The prior art recognizes the need to increase furnace efficiency, whether the furnace be gas or oil fired. Generally, the flue is closed a short time after combustion is terminated. It is recognized that positioning the damper in the flue created problems, such as relatively high temperatures in the environment of the damper and its controls. On occasion the hostile environment caused breakdown of components and operational and maintenance problems. Prior designs incorporating springs or bimetal elements to open or close the damper have been subject to mechanical fatigue.

An object of the present invention is to provide a damper means for a furnace which is positioned adjacent the inlet to the burner means whereby the disadvantages and deficiencies of certain prior damper constructions are obviated.

Another object of the present invention is to provide a damper means for a furnace that is operable to control the flow of air to the heat exchanger, said damper means being closed when the burner means is off and being open when the burner means is on.

Yet another object of the present invention is to provide a furnace with improved damper means for conserving energy during the off cycle of the burner, said damper means being located adjacent an inlet opening to the burner means and heat exchanger for controlling the passage of air through said inlet opening, and said damper means not being disposed in the flue gas environment.

A further object of the present invention is to provide a furance with novel damper means adjacent the inlet to the burner means, said damper means comprising a plate member having a small opening therein for permitting a small quantity of air to reach the burner means when the plate member is closed for supporting a pilot flame.

Other objects and advantages of the present invention will be made more apparent hereinafter.

BRIEF DESCRIPTION OF THE DRAWINGS

There is shown in the drawing a presently preferred embodiment of the present invention wherein, like numerals in the various views refer to like elements and wherein.

DETAILED DESCRIPTION OF THE PRESENT INVENTION

Figure 1:
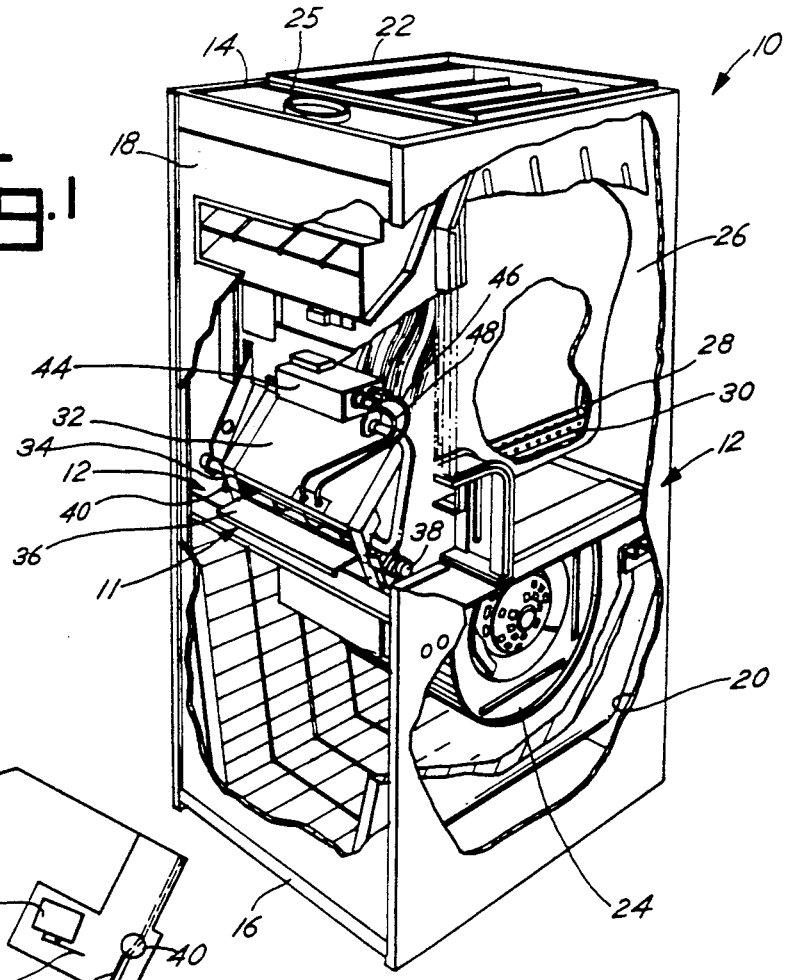
FIG. 1 is a perspective view of a furnace embodying the novel damper means of the present invention.

Referring now to FIG. 1 there is shown a furnace 10 embodying the damper means 11 of the present invention. The furnace may be of the gas-fired or oil-fired typed as may be better understood hereinafter. The furnace 10 includes a housing 12 which has a top 14, a bottom 16 and sidewalls 18. One of the side walls 18 has an opening 20 adapted to be communicated to the return air duct from the area treated and an opening 22 adapted to communicate the furnace to the area to be treated for supplying treated air thereto. A blower means 24 for circulating air through the furnace is secured within the cabinet or housing 12. Filter 23 is disposed in housing 12 in the air flow path between the return air duct and the blower means 24. Flue gases may be vented to the atmosphere through opening 25 in the top 14 of the housing 12.

Disposed within the cabinet or housing 12 is a heat exchanger 26 having a combustion chamber 28 in the bottom thereof. A burner 30 extends into the combustion chamber for operation in a known fashion. The heat exchanger 26 may be of a known clam-shell type and the burner 28 may be of a conventional design having a plurality of rows of practically continuous ports therein.

The entry to the compartment within the cabinet or housing 12 containing the heat exchanger 26 and the burner 30 is closed by a burner box or enclosure 32 which has an opening 34 in the front thereof. The damper means 11 which comprises a pivotally mounted plate member 36 is adapted to open and close the opening 34 to the burner and heat exchanger so as to permit or exclude the passage of air to the burner and the heat exchanger. The damper means 11 will be closed when the burner 30 is off and will be open when the burner 30 is on.

The supply of gas to the burner 30 is controlled by a gas control valve 44 that is operatively connected to the burner 30 via the lines 46 and 48.

The damper means 11 also includes a shaft 40 which is secured rigidly to the damper plate member 36 and is pivotally connected at its ends to the sidewall of the enclosure 32. An electric drive motor 38 is mounted on a bracket 39 secured to a side wall the enclosure 32.

Drive motor 38 is operatively secured to one end of shaft 40 for rotating same to the closed position. A spring is provided within the drive motor 38 to rotate the plate member to the open position. Alternately, a spring may be mounted separately from the drive motor 38 for actuating the plate member 36 to the open position.

Figure 3:
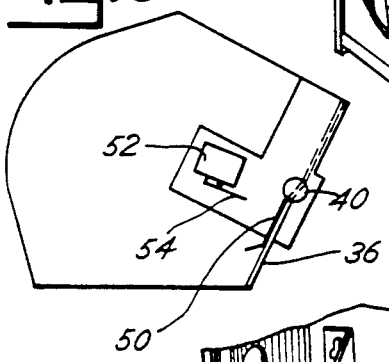
FIG. 3 is a side view of the damper means taken generally along the line 3—3 of FIG. 2.
Figure 2:
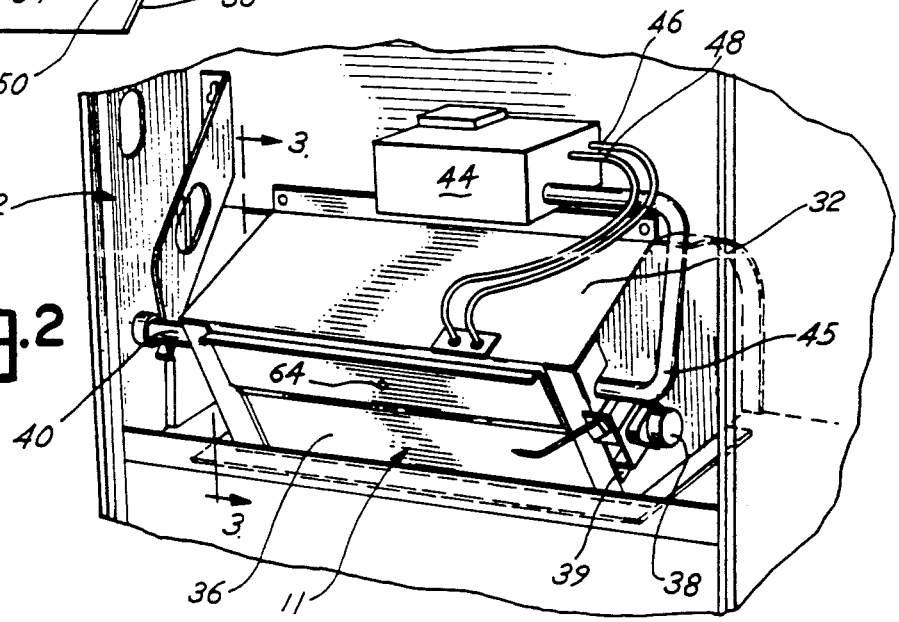
FIG. 2 is a perspective view of the damper means on an enlarged scale.

Turning now to FIGS. 2 and 3, there is better shown the construction of the damper means 11. The damper means 11 is in the form of an elongated generally rectangular plate member 36 that is fixedly secured to the shaft 40 that is pivoted in the side walls fo the enclosure 32. Secured to one end of the shaft 40 is a spring actuator 50. The spring actuator 50 is disposed adjacent a limit switch 52 and the spring actuator 50 is adapted to contact the actuating arm 54 of the limit switch in order to actuate the limit switch 52. When the plate member 36 is moved to the open position, the spring actuator 50 will engage the actuating arm 54 to close the limit switch. The limit switch 52 as described hereafter is in circuit with the gas control valve 44. When the damper 36 is open fully and limit switch 52 is closed, the gas control valve 44 is opened to permit the flow of gas from the gas control valve 44 to the burner means 30.

Figure 4:
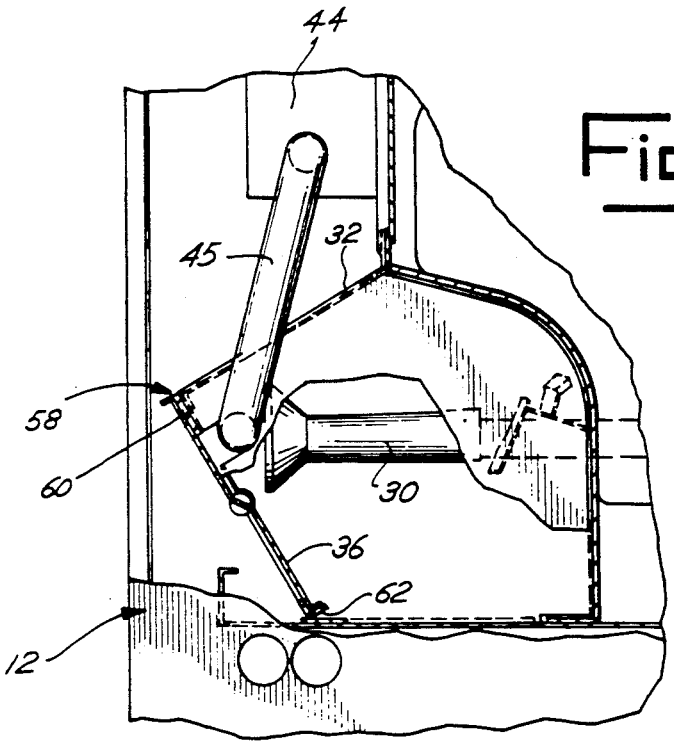
FIG. 4 is an end view of the damper means illustrating same in the closed position.
Figure 5:
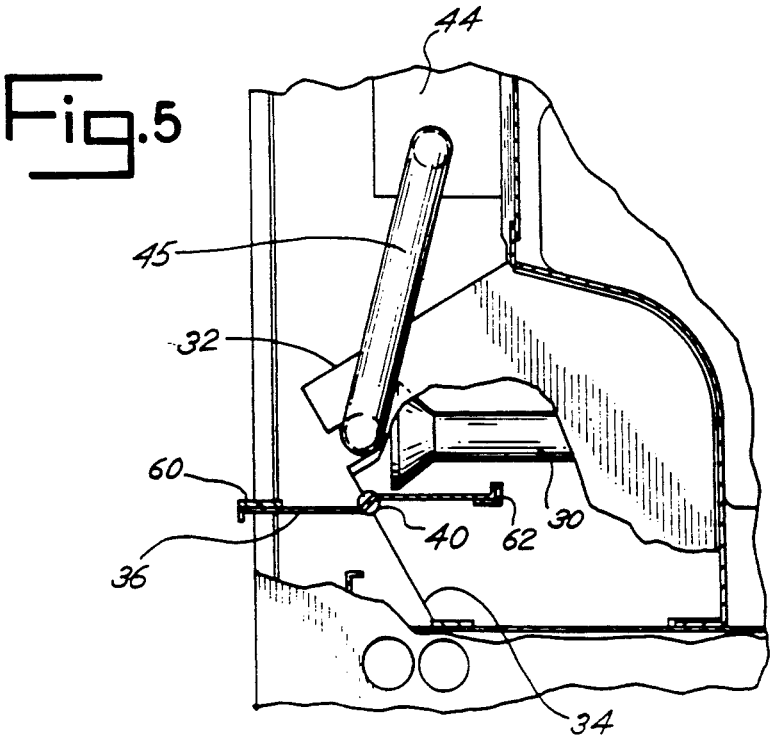
FIG. 5 is an end view similar to FIG. 3 illustrating the damper means in the open position.

Turning now to FIGS. 4 and 5, there is shown the closed and open positions, respectively, of the plate member 36. The line 45 connects the gas control valve 44 to the manifold for the burner means 30.

It is a feature of the present invention that gasket means 58 be provided on the plate member 36 in order to help seal the flow of air to the heat exchanger means when the plate member 36 is in the closed position as shown in FIG. 4. The sealing gasket means 58 may comprise a gasket member 60 at the top of the plate member and a gasket number 62 at the bottom of the plate member 36. The gasket members 60 and 62 extend transversely the width of the plate member 36. The gasket member 60 is adapted to be secured to the plate member 36 and is adapted to seal the top of the plate member 36 with respect to the enclosure or burner box 32. The gasket member 62 is affixed to the bottom of the plate mumber 36 and is adapted to seal the space between the bottom of the plate member and the enclosure 32. It will be understood that the gasket members 60 may be affixed to the face of the enclosure rather than to the plate member 36. Likewise, the gasket material 62 may be affixed to the bottom of the enclosure adjacent the bottom of the plate member 36 in order to effectuate a seal between the bottom of the plate member 36 and the opening to the enclosure 32. The gasket members 60, 62 may be fabricated from a foamed plastic or like sealing material.

With reference now to FIG. 2, it will be noted that there is shown a small opening 64 in the damper 36. The small opening or pilot hole 64 is for the purpose of supplying limited air to the burner means 30 in order to maintain combustion for a pilot flame in certain applications. This is an optional feature that can be used with the damper means 11, if the furnace employes a pilot flame.

Figure 6:
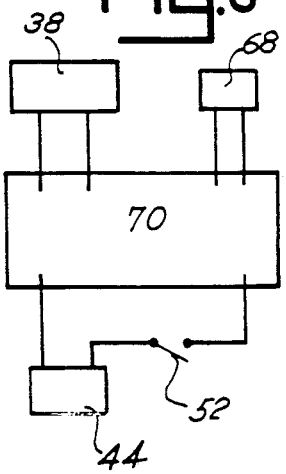
FIG. 6 is a schematic wiring diagram of the damper means control.
Figure 7:
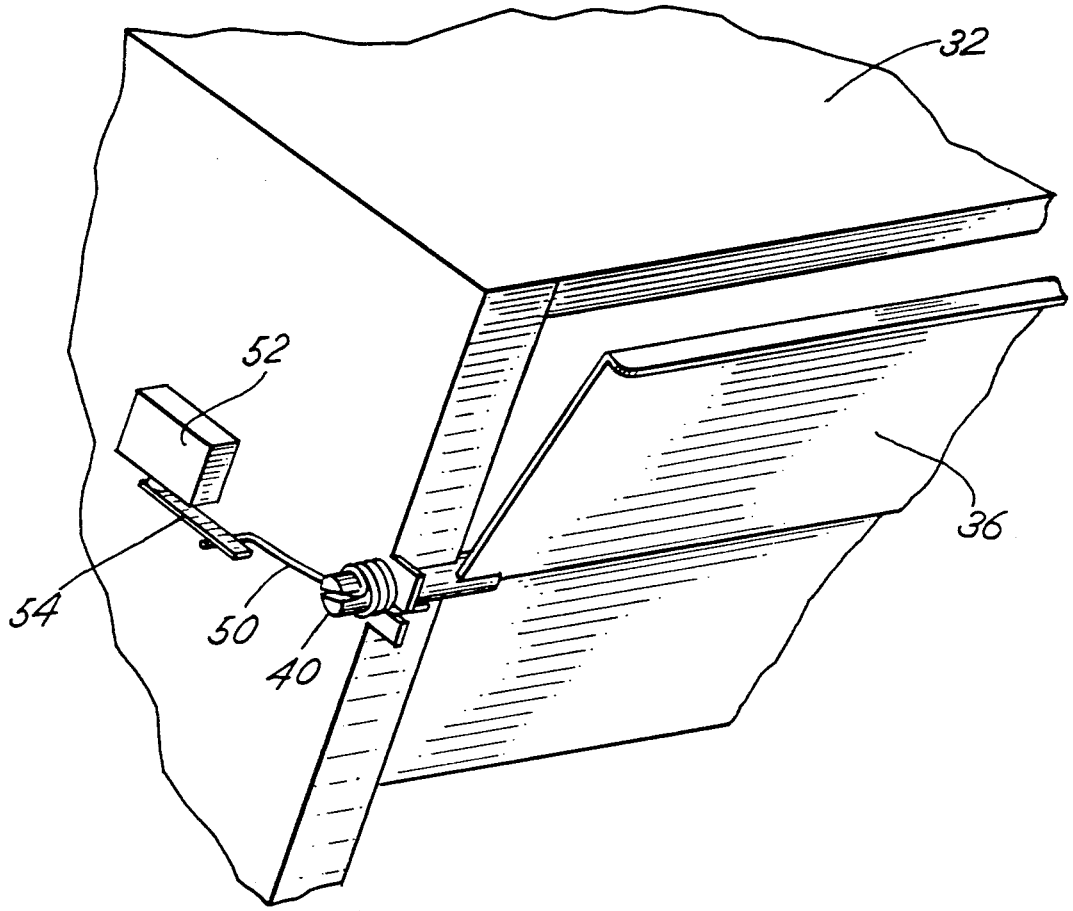
FIG. 7 is an enlarged view of the spring operated limit switch.

In FIG. 6, there is shown a schematic wiring diagram. The damper motor 38 and a room thermostat 68 responsive to the temperature in the area to be conditioned are operatively connected to an electronic control center 70. Also connected to the control center 70 are the gas valve 44 and the limit switch 52. When there is a requirement for heat, the thermostat 68 will send a signal to the control center 70. The damper motor 38 will be actuated to drive the damper 36 open. The gas valve 44 will be opened when the damper 36 is open and the limit switch 52 is closed. Closure of the limit switch 52 verfies that the damper 36 is open.

When there is no longer a demand for heat, the control center 70 will terminate operation of the damper motor 38. The spring within the damper motor 38 will bias the damper shaft 40 to close damper 36. The limit switch 52 is opened. The gas valve 44 will be closed, terminating the supply of gas to the burner 12.

It will be understood that the damper means 11 of the present invention is not disposed in the flue where it may be subject to a corrosive environment. Rather it is positioned adjacent the inlet opening to the heat exchangers that is provided in the enclosure means 32. The damper means 11 is at a cooler location than if it were in the flue and is thus less subject to damage and mechanical problems than a prior art device located within the flue.

The location of the damper means adjacent the opening to the enclosure 32 also functions as a safety. If the damper plate 36 fails in the closed position, oxygen will be used up and the burner 30 will not be ignited. In a prior device where the damper were located in a flue, if the damper failed in a closed position, there could be a fire hazard. Flame could roll out or seek oxygen wherever it could get it.

It will be understood that the limit switch 652 cooperates with the gas control valve 44 in order to limit operation of the control valve to permit the flow of gas only when the damper means is fully opened or substantially fully opened, that is, when the spring actuator 50 on the shaft 40 engages the actuating lever 54 of the limit switch 52. As aforenoted, the motor means 38 will drive the shaft open in opposition to a spring loading, and the spring will rotate the shaft and cause the damper plate 36 to move to its closed position when the burner means 12 is off.

While there has been shown a presently preferred embodiment of the present invention, it is apparent that various changes and modifications may be made therein without departing from the invention. Therefore, it is intended in the appended claims to cover all such changes and modifications as fall within the true spirit and scope of the invention.

I claim:

1. In a furnace for heating an area comprising a housing, fan means for moving air through said housing, burner means in the housing, fuel supply means operatively connected to the burner means, combustion chamber means in the housing operatively associated with the burner means, and heat exchanger means in the housing operatively connected with the combustion chamber means, there being an entry opening in the housing, the improvement characterized by enclosure means positioned on the housing to enclose said entry opening, said enclosure means having a damper opening therein, damper means operable to control the flow of air through the damper opening to the burner means, said damper means comprising a pivotally mounted plate member that is in a closed position when the burner means is off and is in an open position when the burner means is on, said plate member being pivotally mounted on said enclosure means, drive means for pivoting the plate member to the open position, spring means for biasing the plate member to the closed position, control means for actuating the drive means for positioning the damper means in response to the attainment of a predetermined temperature in the area to be heated and, a limit switch cooperating with the fuel supply means, said damper means including a rotatable shaft to which the plate member is secured, and a spring actuator on said shaft for actuating said limit switch, whereby when the plate member is moved to the open position by the spring means, the spring actuator will close the limit switch and the fuel supply means will supply fuel to the burner means, and when the plate member is moved to the closed position, by the drive means, the limit switch can open and the supply of fuel from the fuel supply means to the burner means will be terminated.

2. A furnace as in claim 1 including switch means in circuit with the fuel supply means and responsive to a predetermined open position of the plate member for permitting the flow of fuel through the fuel supply means when the plate member is open to said predetermined open position.

3. A furnace as in claim 1 including a pilot hole in said plate member for supplying limited air to said burner means to maintain combustion for a pilot flame.

4. A furnace as in claim 2 wherein the fuel is gas and fuel supply means is a gas valve.

5. In a furnace for heating an area comprising a housing, fan means for moving air through said housing, burner means in the housing, fuel supply means operatively connected to the burner means, combustion chamber means in the housing operatively associated with the burner means, and heat exchanger means in the housing operatively connected with the combustion chamber means, there being an entry opening in the housing, the improvement characterized by enclosure means positioned on the housing to enclose said entry opening, said enclosure means having a damper opening therein, damper means operable to control the flow of air through the damper opening to the burner means, said damper means comprising a pivotally mounted plate member that is in a closed position when the burner means is off and is in an open position when the burner means is on, said plate member being pivotally mounted on said enclosure means, drive means for pivoting the plate member to the open position, spring means for biasing the plate member to the closed position, control means for actuating the drive means for positioning the damper means in response to the attainment of a predetermined temperature in the area to be heated, a limit switch cooperating with the fuel supply means, and an actuator on said damper means and adapted to move relative to said limit switch for actuating said limit switch whereby when the plate member is moved to the open position by the spring means, the actuator on the damper means will close the limit switch and the fuel supply means will supply fuel to the burner means, and when the plate member is moved to the closed position, by the drive means, the limit switch can open and the supply of fuel from the fuel supply means to the burner means will be terminated.

* * * * *

UNITED STATES PATENT AND TRADEMARK OFFICE

CERTIFICATE OF CORRECTION

PATENT NO. : 5,056,500

DATED : October 15, 1991

INVENTOR(S) : Lance J. Evens

It is certified that error appears in the above-identified patent and that said Letters Patent is hereby corrected as shown below:

On title page, item [73] add Assignee: should read --Lennox Industries Inc., Dallas, Tex.--

Signed and Sealed this

Sixteenth Day of November, 1993

*Attest:*

Bruce Lehman

BRUCE LEHMAN

*Attesting Officer*

*Commissioner of Patents and Trademarks*